US010331151B1

(12) United States Patent
Chu

(10) Patent No.: US 10,331,151 B1
(45) Date of Patent: Jun. 25, 2019

(54) SYSTEMS FOR GENERATING PROCESS, VOLTAGE, TEMPERATURE (PVT)-INDEPENDENT CURRENT

(71) Applicant: Micron Technology, Inc., Boise, ID (US)

(72) Inventor: Wei Lu Chu, Xuhui District (CN)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 16/203,320

(22) Filed: Nov. 28, 2018

(51) Int. Cl.

| | |
|---|---|
| ***G05F 1/56*** | (2006.01) |
| ***G05F 1/567*** | (2006.01) |
| ***G05F 3/30*** | (2006.01) |
| ***G05F 1/46*** | (2006.01) |
| ***G05F 1/59*** | (2006.01) |

(52) U.S. Cl.
CPC ..... *G05F 1/567* (2013.01); *G05F 1/463* (2013.01); *G05F 1/59* (2013.01); *G05F 3/30* (2013.01)

(58) Field of Classification Search
CPC ... G05F 1/56; G05F 1/59; G05F 1/463; G05F 1/563; G05F 1/567; G05F 1/575; G05F 3/30; G05F 3/245; H02M 3/156–158; H02M 3/1584; H02M 2001/0032; H02M 2001/0045
USPC ..... 323/265–268, 274, 277
See application file for complete search history.

(56) References Cited

U.S. PATENT DOCUMENTS

| | | | | |
|---|---|---|---|---|
| 7,737,769 | B2 * | 6/2010 | Deng | G05F 3/30 327/539 |
| 9,035,630 | B2 * | 5/2015 | Krenzke | G05F 3/30 323/273 |
| 9,471,084 | B2 * | 10/2016 | Kobayashi | G05F 3/16 |
| 9,864,393 | B2 * | 1/2018 | Horng | G05F 3/245 |
| 9,915,966 | B2 * | 3/2018 | Chou | G05F 3/16 |
| 10,073,477 | B2 | 9/2018 | Chu | |

* cited by examiner

*Primary Examiner* — Yemane Mehari
(74) *Attorney, Agent, or Firm* — Fletcher Yoder, P.C.

(57) ABSTRACT

Systems and devices are provided for generating a process, voltage, temperature (PVT)-independent reference current in a resource-efficient manner. A semiconductor device may include a bandgap circuit that outputs a reference voltage and gate signal. The semiconductor device may also include a reference current circuit that includes a complementary-to-absolute-temperature (CTAT) current generation portion and a variation-independent reference current generation portion. The variation-independent reference current generation portion may receive the gate signal from the bandgap circuit, apply the gate signal to a proportion-to-absolute temperature (PTAT) branch of the variation-independent reference current generation portion, and generate mirror PTAT and CTAT currents. The reference current circuit may also include a reference node that generates the reference current supply based at least in part on the mirror CTAT current and the mirror PTAT current.

20 Claims, 5 Drawing Sheets

200

SYSTEMS FOR GENERATING PROCESS, VOLTAGE, TEMPERATURE (PVT)-INDEPENDENT CURRENT

BACKGROUND

The present disclosure relates generally to the field of bandgap circuits and, more particularly, to techniques for generating a process, voltage, temperature (PVT)-independent reference current using bandgap circuits.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices, such as semiconductor devices, memory chips, microprocessor chips, image chips, and the like, may include circuitry that performs various operations based on a provided reference voltage. For example, the circuitry may be reference current circuitry that uses the reference voltage to generate a current supply to components (e.g., electrical loads) of the electronic device. The reference current circuitry however, may generate a reference current that deviates from a target current magnitude due to process (e.g., semiconductor fabrication, loading), supply voltage, or operating temperature (PVT) variations. These deviations may result in the electronic device functioning in an unintended manner.

Further, the reference current circuitry may consume resources, such as available device space and power. In mobile electronic devices, the consumption of such resources by the reference current circuitry may be constrained by device specifications. Accordingly, embodiments of the present disclosure may be directed to systems and devices for generating a PVT-independent reference current while reducing consumption of resources by the reference current circuitry.

BRIEF DESCRIPTION OF DRAWINGS

Various aspects of this disclosure may better be understood upon reading the following detailed description and upon reference to the drawings in which.

DETAILED DESCRIPTION

Figure 1:
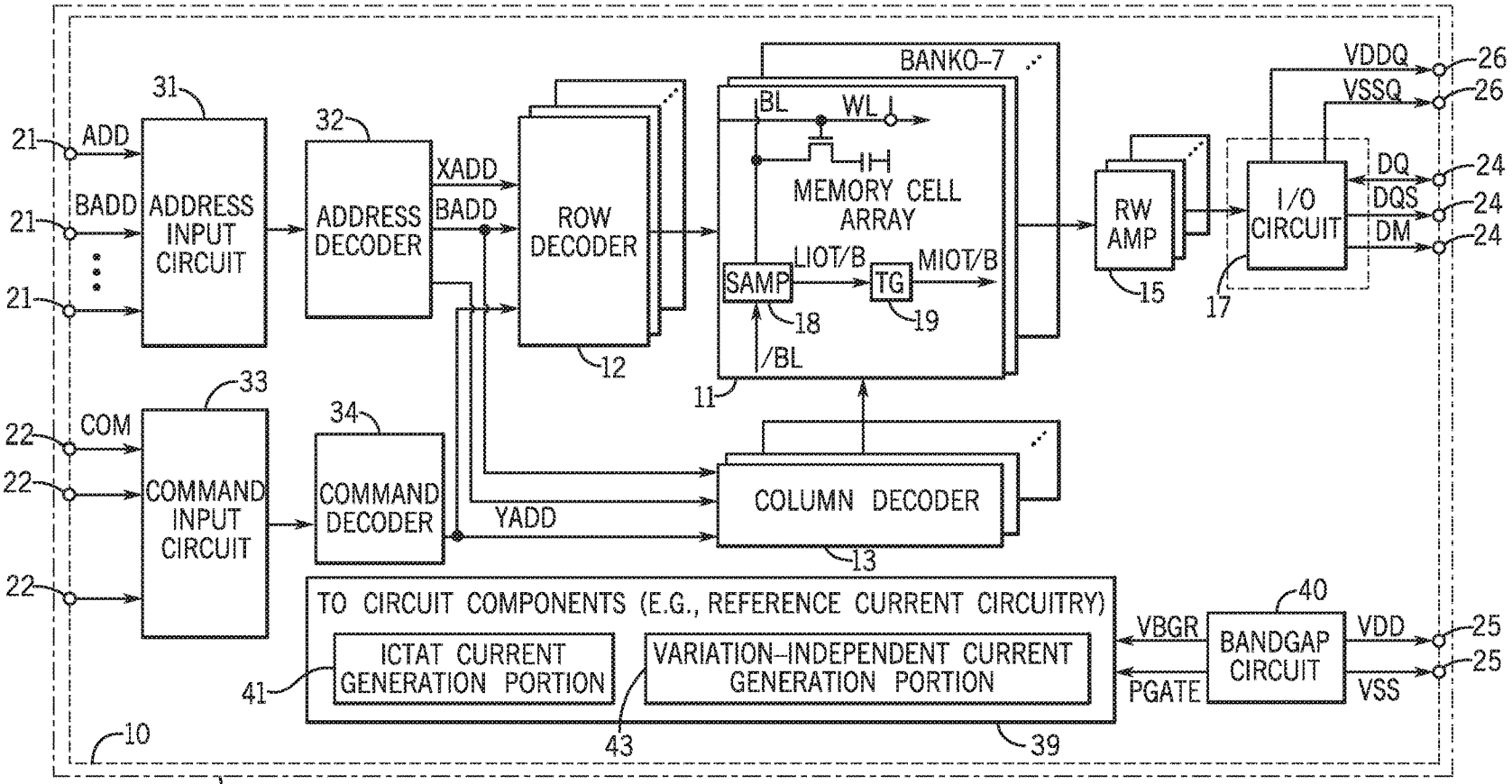
FIG. 1 is a simplified block diagram illustrating a semiconductor device that includes a bandgap circuit and a reference current circuit, in accordance with an embodiment of the present disclosure.

One or more specific embodiments will be described below. To provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure generally relates to mobile electronic devices that employ reference current circuitry and bandgap circuitry to generate a constant reference current. Generally, certain operations of electronic devices may rely on a reference current. For example, a reference current may be used as a biasing source for oscillators of the electronic device, amplifiers of the electronic device, and the like. Circuitry, such as reference current circuitry, may be used to generate the reference current based on a reference voltage. To improve accuracy of the generated reference current, the reference current circuitry may use a reference voltage ($V_{bgr}$) output by a bandgap circuit. The bandgap circuit may output a $V_{bgr}$ that is stabilized (e.g., constant) at a particular voltage level regardless of various circuit loads, power supply variations, temperature changes, and the like (PVT conditions). As such, when the current generated by the reference current circuitry is based on the $V_{bgr}$, the generated current may also be independent of PVT variations.

In particular, the reference current circuitry may use the $V_{bgr}$ output by the bandgap circuit to generate proportional-to-absolute-temperature currents ($I_{PTAT}$) and complementary-to-absolute temperature currents ($I_{CTAT}$), both of which may be manipulated by the reference current circuitry to generate the PVT-independent reference current. Briefly, certain circuit elements, such as diodes, metal-oxide field effect transistors (MOSFETs), and the like, may be composed of active materials with resistances that change inversely with respect to temperature. Thus, when the $V_{bgr}$ is applied across such circuit elements as the temperature varies, the current ($I_{PTAT}$) may also vary in proportion to the temperature changes. Further, when the $V_{bgr}$ is applied across a resistor as temperature varies, the resistance of the resistor may increase as the temperature increases, resulting in a current ($I_{CTAT}$) that has a decreasing magnitude as the temperature increases. Because the $I_{PTAT}$ and $I_{CTAT}$ are based on a PVT-independent reference voltage (e.g., $V_{bgr}$), the magnitude of both currents may change in a complimentary manner relative to each other. Thus, the reference current circuitry may use $I_{PTAT}$ and $I_{CTAT}$ to cancel PVT-based variations and thereby produce a stable reference current that is independent of PVT conditions.

In some instances, the reference current circuitry may employ circuit elements that consume relatively large amounts of space and power to generate the $I_{PTAT}$ and/or $I_{CTAT}$ When such reference current circuitry is employed in electronic devices operating under constrained resources, the consumption of resources by the reference current circuitry may force design compromises. For example, relatively small and/or mobile electronic devices may constrain the size, current consumption, and/or heat generation of its components, including restrictions to the reference current circuitry.

Accordingly, the present disclosure provides systems and techniques for generating a PVT-independent reference current in a resource-efficient manner by using outputs of a bandgap circuit to provide a stable reference and to avoid use of resource-consuming circuit elements (e.g., large resistor) in the reference current circuitry. In some embodiments, a reference current circuit may include a complementary-to-absolute-temperature ($I_{CTAT}$) current generation portion and a variation-independent current generation portion. Each portion of the reference current circuit may receive a stable, PVT-independent signal from a bandgap circuit. In particular, the $I_{CTAT}$ current generation portion may generate the $I_{CTAT}$ current based on the voltage output ($V_{bgr}$) from the bandgap circuit. The variation-independent current generation portion may receive a gate signal ($P_{gate}$) from the bandgap circuit and generate a mirror (e.g., emulate) $I_{PTAT}$ current of the bandgap circuit's $I_{PTAT}$ current using the gate signal.

Further, in some embodiments, the variation-independent current generation portion may also receive a signal from the $I_{CTAT}$ current generation portion, which may be used by the variation-independent current generation to generate a mirror (e.g., emulate) $I_{CTAT}$ current of the $I_{CTAT}$ current generation portion's $I_{CTAT}$ current. The variation-independent current generation portion may use the mirrored $I_{CTAT}$ current and the mirrored $I_{PTAT}$ current to cancel out PVT variations, thereby generating a stable reference current that is independent of PVT variations. Additional details with regard to generating the PVT-independent reference current will be described below with reference to FIGS. 1-5.

With this in mind, FIG. 1 illustrates a semiconductor device 10 that includes a reference current circuit 39 and a bandgap circuit 40, in accordance with an embodiment of the present disclosure. Although the following description of the semiconductor device 10 will be described in the context of a memory device, it should be noted that the embodiments described herein may be employed for any suitable electronic device. Indeed, the description of the memory device below is provided to explain certain aspects of the reference current circuit 39 and the bandgap circuit 40 of the present disclosure, and, as such, the embodiments described herein should not be limited to memory devices.

The semiconductor device 10 may be any suitable memory device, such as a low power double data rate type 4 (LPDDR4) synchronous dynamic random-access memory (SDRAM) integrated onto a single semiconductor chip or a low power double data rate type 5 (LPDDR5). The semiconductor device 10 may be mounted on an external substrate 2, such as a memory module substrate, a motherboard, and the like. The semiconductor device 10 may include a plurality of memory banks each having a plurality of memory cell arrays 11. Each memory cell array 11 may include a plurality of word lines WL, a plurality of bit lines BL, and a plurality of memory cells MC arranged at intersections of the plurality of word lines WL and the plurality of bit lines 13L. The selection of the word line WL, is performed by a row decoder 12 and the selection of the bit line BL is performed by a column decoder 13. Sense amplifiers (SAMP) 18 are coupled to corresponding bit lines BL and connected to local input/output (I/O) line pairs LIOT/B. Local IO line pairs LIOT/B are connected to main IO line pairs MIOT/B via transfer gates (TG) 19, which function as switches to control signal flow.

The semiconductor device 10 may also include a plurality of external terminals, which may communicate with other electrical components/devices. The external terminals may, in turn, include address terminals 21, command terminals 22, data terminals 24, and power supply terminals 25, 26. In particular, the address terminals 21 are supplied with an address signal ADD and a bank address signal BADD. The address signal ADD and the bank address signal BADD supplied to the address terminals 21 are transferred via an address input circuit 31 to an address decoder 32. The address decoder 32 receives the address signal ADD and supplies a decoded row address signal XADD to the row decoder 12 as well as a decoded column address signal YADD to the column decoder 13. The address decoder 32 also receives the bank address signal BADD and supplies the bank address signal BADD to the row decoder 12 and the column decoder 13.

The command terminals 22 are supplied with a command signal COM. The command signal COM may include one or more separate signals. The command signal COM input to the command terminals 22 is transferred to a command decoder 34 via the command input circuit 33. The command decoder 34 decodes the command signal COM to generate various internal command signals. For example, the internal commands may include a row command signal to select a word line WL and a column command signal, such as a read command or a write command, to select a bit line BL. Additionally, the data terminals 24 may be coupled to output buffers for read operations of memories or to input buffers for read/write access of the memories.

Although the address terminals 21 and the command terminals 22 are illustrated as separate terminals, it should be appreciated that in some embodiments, the address input circuit 31 and the command input circuit 33 may receive address signals ADD and command signals COM via the same terminal. For instance, the address and command terminals may provide an address signal at a falling clock edge (e.g., in synchronism with clock falling edge) and a command signal at a rising clock edge (e.g., in synchronism with clock rising edge). Further, the data terminals 24 may also be a single terminal that alternatively receives data signals (DQ, DQS, DM).

Accordingly, the address signals ADD, BADD and the command signals COM may be used to access a memory cell MC in the memory cell array 11. As an example, when a command signal COM indicating a read operation is timely supplied to a word line WL and a bit line BL designated by a respective row address and column address of the address signal ADD, data may be read from the memory cell MC associated with the row address and column address. The read data DQ may be output externally from the data terminals 24 via a read/write amplifier 15 and an input/output circuit 17. Similarly, when a command signal COM indicating a write operation is timely supplied to a word line WL and a bit line BL designated by a respective row address and column address of the address signal ADD, data DQ may be written to the memory cell MC associated with the row address and column address. The write data DQ may be supplied to the memory cell MC after being received from the data terminals 24, the input/output circuit 17, and the read/write amplifier 15.

In some embodiments, the input/output circuit 17 may include input buffers that store data for processing and/or transmission. Further, the input/output circuit 17 receives a timing signal from an external clock that controls input timing of read data DQ and output timing of write data DQ. The input/output circuit 17 may be powered using dedicated power supply potentials VDDQ and VSSQ, such that power supply noise generated by the input/output circuit 17 does not propagate to the other circuit blocks. The power supply potentials VDDQ and VSSQ may be of the same potentials as power supply potentials VDD and VSS that are supplied to power supply terminals 25, respectively.

In particular, the power supply potentials VDD and VSS may be supplied to a bandgap circuit 40. In some embodiments, the bandgap circuit 40 may output a constant (e.g., fixed) voltage ($V_{bgr}$) and gate signal ($P_{gate}$) independent of process variations (e.g., circuit loading), power supply variations, temperature changes, and the like. In other words, the $V_{bgr}$ voltage may be independent of PVT condition variations. The bandgap circuit 40 may generate various internal potentials VPP, VOD, VARY, VPERI that are provided to circuit elements of the semiconductor device 10. For example, the internal potential VPP may be mainly used in the row decoder 12 and the reference current circuitry 39, the internal potentials VOD and VARY may be mainly used in the sense amplifiers 18 included in the memory cell array 11, and the internal potential VPERI may be used in many other circuit blocks.

Further, the bandgap circuit 40 may output the generated signals $V_{bgr}$, $P_{gate}$ to the other circuit elements, such as the reference current circuitry 39. For example, the output potential $V_{bgr}$ may be supplied to an $I_{CTAT}$ current generation portion 41 of the reference current circuitry 39 to generate an $I_{CTAT}$ current. Additionally or alternatively, the $P_{gate}$ gate signal may be supplied to the variation-independent current generation portion 43 of the reference current circuitry 39 to generate an $I_{PTAT}$ current. Thus, the output signals $V_{bgr}$, $P_{gate}$ may facilitate the generation of a constant current supply that powers additional circuit elements (e.g., amplifiers, oscillators) of the semiconductor device 10.

Figure 2:
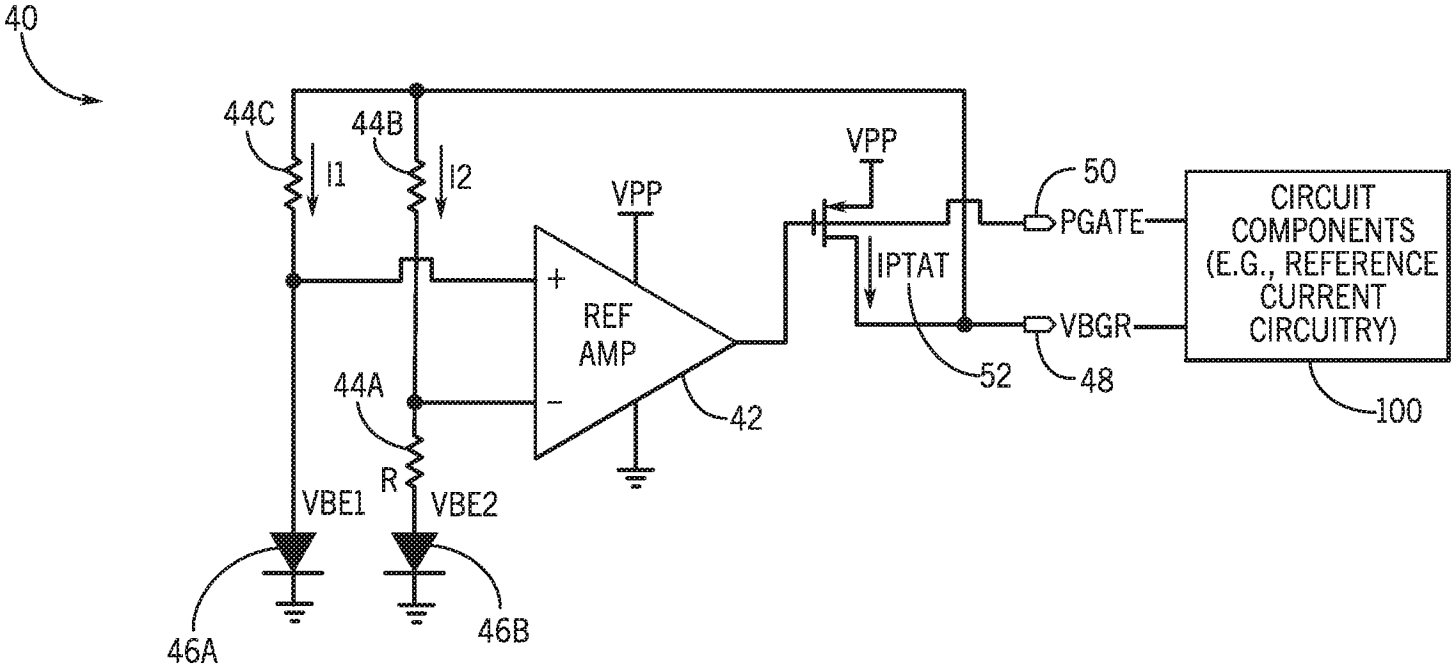
FIG. 2 is a schematic diagram of the bandgap circuit included in the semiconductor device of FIG. 1, in accordance with an embodiment of the present disclosure.

FIG. 2 illustrates a schematic diagram of the bandgap circuit 40 that may produce output signals $V_{bgr}$, $P_{gate}$ to the reference current circuitry 39, in accordance with an embodiment of the present disclosure. As shown, the bandgap circuit 40 may include a differential reference amplifier circuit 42, one or more resistors 44A-44C that may have the same or different resistances, and one or more diodes 46A, 46B. Briefly, the bandgap circuit 40 may use a voltage difference across the diodes 46A, 46B to generate the output signals $V_{bgr}$, $P_{gate}$. In particular, the diodes 46A, 46B may be of different sizes (e.g., different current densities). Thus, the voltage drop $V_{be1}$ that appears across the diode 46A in response to current I1 flow may be different than the voltage drop $V_{be2}$ across the diode 46B in response to current I2 flow. Since the voltage behavior of diodes 46A, 46B is inversely dependent on temperature, the voltages $V_{be1}$ and $V_{be2}$ are CTAT voltages that decrease in magnitude as the temperature increases.

The differential reference amplifier 42 may drive I1 to equal 12. Once equal, the voltage difference between $V_{be1}$ and $V_{be2}$ over the resistor 44A is a PTAT voltage over the resistor 44A. That is, because the differential voltage ($\Delta V_{be}=V_{be1}-V_{be2}$) is proportional to temperature ($\Delta V_{be} \propto (kT)/Q$), the differential voltage may increase as the temperature increases in a manner opposite to that of the CTAT voltage. The bandgap circuit 40 may then use the PTAT voltage and CTAT voltage to cancel the temperature variations of each voltage magnitude and thus, may output a stable reference voltage $V_{bgr}$ 48 that does not vary with PVT conditions. Further, the differential reference amplifier 42 may output a $P_{GATE}$ gate signal 50 and may generate an $I_{PTAT}$ current comprising a summation of I1 and I2.

Figure 3:
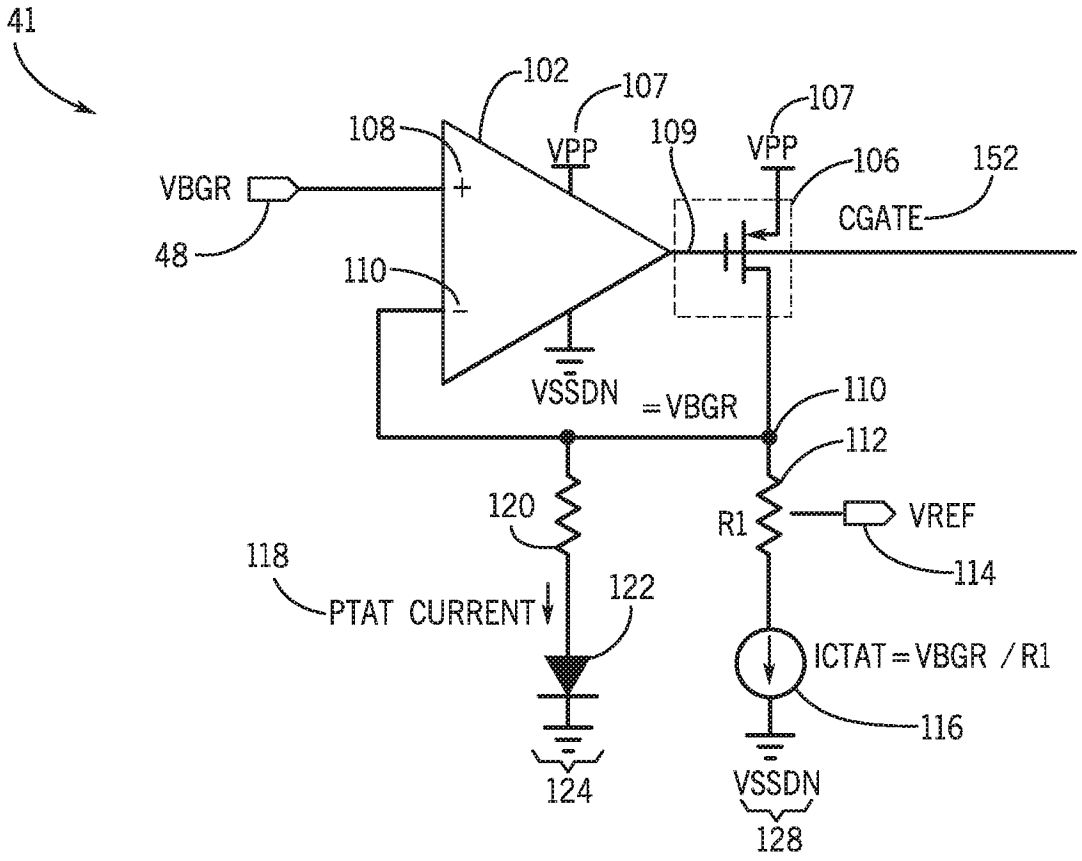
FIG. 3 is a schematic diagram of a complementary-to-absolute-temperature (CTAT) current generation portion of the reference current circuit of FIG. 1, in accordance with an embodiment of the present disclosure.

The reference current circuitry 39 may use the outputs of the bandgap circuit 40 and the complimentary behavior of CTAT and PTAT voltages/current to generate a reference current that is independent of PVT variations. FIG. 3 illustrates a schematic diagram of the $I_{CTAT}$ current generation portion 41 of the reference current circuit 39, in accordance with an embodiment of the present disclosure. As shown, the $I_{CTAT}$ current generation portion 41 may include a voltage follower amplifier 102 that receives the reference voltage $V_{bgr}$ 48 at its positive input terminal 108 from the bandgap circuit 40. As previously mentioned, the $V_{bgr}$ 48 is a PVT-independent voltage. An output 109 of the voltage follower amplifier 102 may be equivalent to the input 48 of the voltage follower amplifier 102. That is, the output 109 and a negative input terminal 110 of the voltage follower amplifier 102 are at a potential equivalent to $V_{bgr}$ 48. In some embodiments, the $V_{bgr}$ 48 may be 1.2 V or another suitable voltage. The voltage follower amplifier 102 may act as a buffer between the bandgap circuit 40 and electrical loads, thereby avoiding loading of the bandgap circuit 40.

A MOSFET 106, may be coupled to the output 109 at a gate of the MOSFET 106. Similar to the voltage follower amplifier 102, the MOSFET 106 may be driven (e.g., powered) using power supply potential VPP 107. The MOSFET 106 may be used to provide current source functionality in an $I_{CTAT}$ branch 128 of the $I_{CTAT}$ current generation portion 41 based on the voltage of the output 109 applied to the gate of the MOSFET 106. This may set the current in the MOSFET 106 and current of R1 112 such that the voltage across R1 112 (e.g., $V_{ref}$ 114) is equivalent to the input voltage $V_{bgr}$ 48. In some embodiments, $V_{ref}$ 114 may be tapped out to a comparator to ensure that the $V_{ref}$ 114 value is in a certain threshold range. Although discussions of the bandgap circuit 40 refer to use of a MOSFET, any suitable transistor (e.g., bipolar junction transistors (BJTs), other field-effect transistors (FETs), and the like) may be used in the bandgap circuit 40.

Using ohm's law, the current flowing from the MOSFET 106 and through R1 112 is $V_{bgr}$/R1. The current may be a CTAT current ($I_{CTAT}$ 116) that varies inversely with temperature changes. In particular, as the temperature increases, the resistance of R1 112 may increase, and thus, the magnitude of $I_{CTAT}$ 116 decreases. As such, the $I_{CTAT}$ branch 128 of the reference current circuit 39 may generate an $I_{CTAT}$ current 116 using the $V_{bgr}$ 48 output from the bandgap circuit 40.

In some embodiments, $I_{CTAT}$ current generation portion 41 may also include an $I_{PTAT}$ branch 124 that generates an $I_{PTAT}$ current 118. For example, the $V_{bgr}$ 48 across a resistor 120 may generate an $I_{PTAT}$ current 118. Because diodes 122 are formed of active material that allow for increase current flow through the diode 122 as the temperature increases, the current 118 may be a PTAT current, or a current with a magnitude that increases as the temperature increases. Since the $I_{CTAT}$ 116 and the $I_{PTAT}$ 118 are complementary in their dependency on temperature, the reference current circuitry 39 may use the currents 116, 118 to cancel out temperature-induced fluctuations and thus, to generate a stable reference current. However, resistors (e.g., 120) consume relatively large amounts of space, for example, as compared to transistors. Further, resistors (e.g., 120) may consume large amounts of currents and/or generate heat. As such, using resistors to generate the $I_{PTAT}$ 118 may not be practical or feasible in at least some electronic devices (e.g., mobile electronic devices) that are constrained on resources, such as power and size. Thus, embodiments of the present disclosure may avoid using bulky circuit elements to generate the stable reference current by using a bandgap circuit 40 output to generate the $I_{PTAT}$ 118. Instead, as discussed below in relation to FIG. 4, the $I_{PTAT}$ current 118 may be generated without using resistors and/or other relatively large or relatively high-power-consuming circuit elements.

Figure 4:
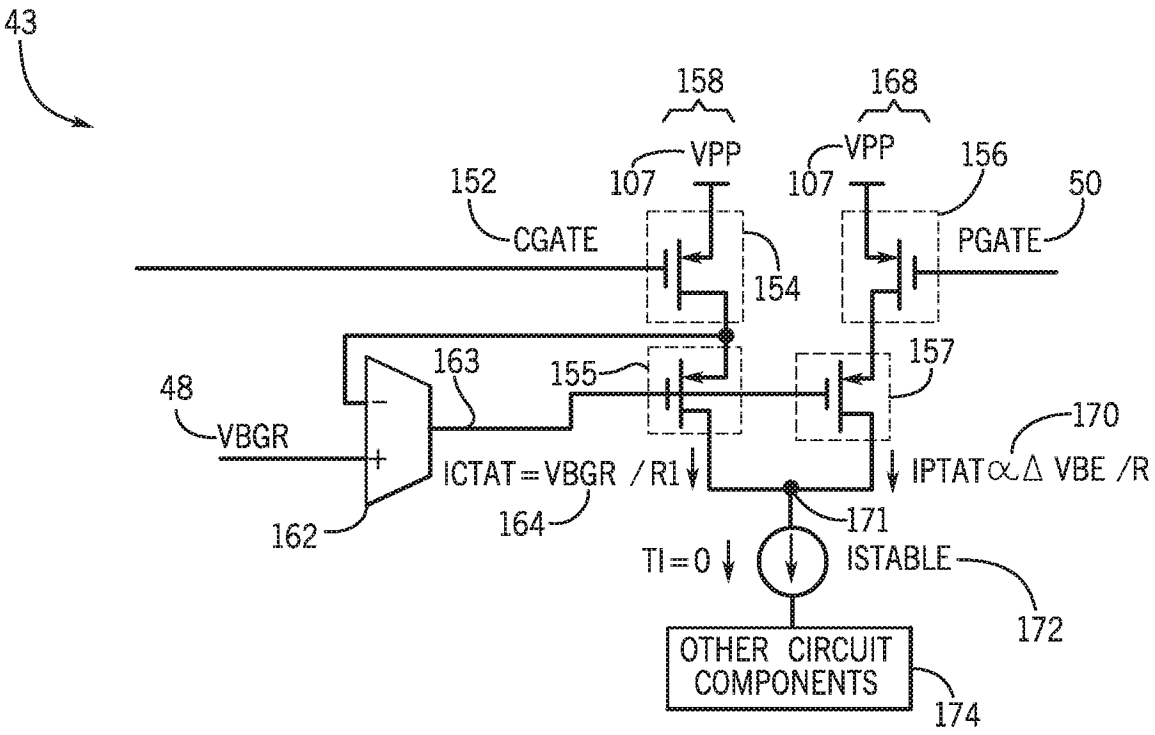
FIG. 4 is schematic diagram of a variation-independent current generation portion of the reference current circuit of FIG. 1, in accordance with an embodiment of the present disclosure.

FIG. 4 details a schematic diagram of a variation-independent current generation portion 43 of the reference current circuit 39 that may avoid use of bulky and high-power consuming circuit elements to generate a stable reference current, in accordance with an embodiment of the present disclosure. As shown, the variation-independent current generation portion 43 may include a mirror CTAT branch 158 that generates a mirror $I_{CTAT}$ 164 and a mirror PTAT branch 168 that generates a mirror $I_{PTAT}$ 170.

The mirror CTAT branch 158, along with the $I_{CTAT}$ branch 128, may function as a current mirror, thereby facilitating the generation of the mirror $I_{CTAT}$ 164. In particular, a gate terminal of a MOSFET 154 may receive the Cgate signal 152 from the $I_{CTAT}$ branch 128. The Cgate signal 152 may be equivalent in magnitude to the output 109 used to drive the MOSFET 106. In other words, the gates of MOSFET 106 and MOSFET 154 may be tied together and to the Cgate signal 152. Further, a source terminal of the MOSFET 154, like the source of the MOSFET 106, may be tied to the power supply potential VPP 107. A drain terminal of the MOSFET 154 may be coupled to an operational transconductance amplifier (OTA) 162, which in turn may be coupled to a source terminal of an additional MOSFET 155 of the mirror CTAT branch 158. The drain terminal of the MOSFET 154 may have a voltage based on $V_{bgr}$ 48, similar to that of the drain of the MOSFET 106, thereby further tying together the mirror CTAT branch 158 and the $I_{CTAT}$ branch 128.

An output 163 of the OTA 162 may be used to control behavior of an additional MOSFET 155 of the mirror CTAT branch 158. For example, the output 163 may be coupled to a gate terminal of the MOSFET 155 and when the output 163 is above a gate voltage threshold, the MOSFET 155 may allow for current flow (e.g., of the mirror $I_{CTAT}$ 164) through the MOSFET 155. A source terminal of the MOSFET 155 may be coupled to the drain of MOSFET 154 and to a negative input terminal of the OTA 162. A drain terminal of the MOSFET 155 may be coupled to a reference node 171, which will be discussed in more detail below. The connection configuration of MOSFETS 106, 154, and 155 facilitate the mirroring of $I_{CTAT}$ 116 in the variation-independent current generation portion 43 and thus, the generation of the mirror $I_{CTAT}$ 164. Mirroring the $I_{CTAT}$ current 116 is advantageous as it improves accuracy of the generated mirror current 164 value, enables the mirrored $I_{CTAT}$ current 164 to remain constant regardless of load conditions, and enables mirroring of the $I_{CTAT}$ current 164 to remain constant regardless of the input driving conditions to the MOSFET 154.

Additionally, the mirror PTAT branch 168, along with the bandgap circuit 40, may function as a current mirror, thereby facilitating the generation of the mirror $I_{CTAT}$ 170. As previously noted, an $I_{PTAT}$ current 170 may be generated without using relatively large and/or relatively high-resource-consuming circuit elements. In particular, the mirror PTAT branch 168 may include a MOSFET 156 that may have a source terminal coupled to the power supply potential VPP 107 and may receive the $P_{gate}$ gate signal 50 output by the bandgap circuit 40 at a gate terminal of the MOSFET 156. A drain terminal of MOSFET 156 may be coupled to a source terminal an additional MOSFET 157.

The gate terminal of the MOSFET 157 may also receive the output 163 of the OTA 162, which may be used to control behavior of the MOSFET 157. For example, when the output 163 is above a gate voltage threshold, the MOSFET 157 may allow for current flow (e.g., of the mirror $I_{PTAT}$ 170) through the MOSFET 157. A drain terminal of the MOSFET 157 may be coupled to the reference node 171, along with the drain terminal of the MOSFET 155.

The connection configuration of MOSFETs 156 and 157 and the bandgap circuit 40 may facilitate the mirroring of the $I_{PTAT}$ 52 already existing in the bandgap circuit 40 and thus, the generation of the mirror $I_{PTAT}$ 170. Further, rather than using a PTAT branch (e.g., 124) that uses a large resistor 120 and diode 122, the mirror PTAT branch 168 may be composed of two relatively small and power-efficient transistor devices that emulates output signals (e.g., $P_{gate}$ gate signal 50) from the bandgap circuit 40 to generate the $I_{PTAT}$ current 170. Although discussion of the mirror CTAT branch 158 and the mirror PTAT branch 168 focuses on the use of MOSFETS, it should be appreciated that any suitable transistor (e.g., bipolar junction transistors (BJTs), other field-effect transistors (FETs), and the like) may be used in the variation-independent current generation portion 43.

Figure 5:
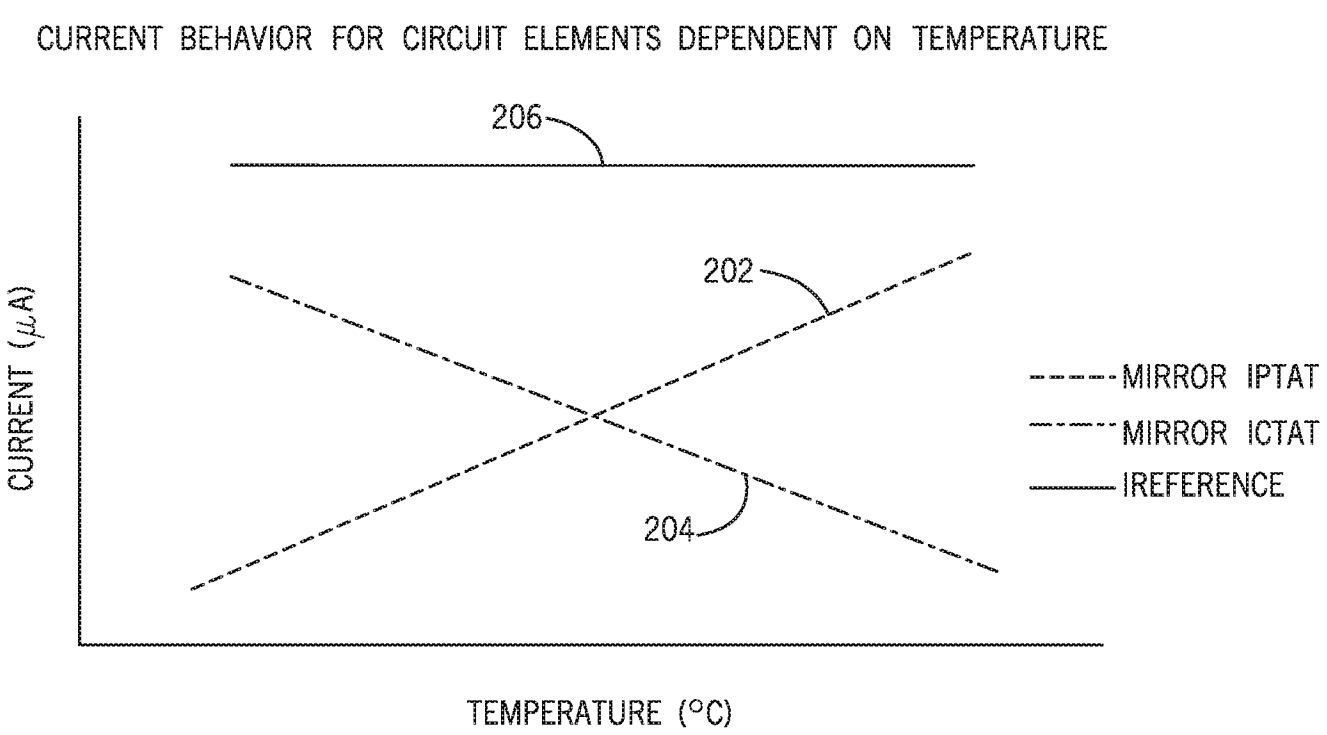
FIG. 5 is a graph of current behavior with regards to temperature variations, in accordance with an embodiment of the present disclosure.

At the reference node 171, the mirror $I_{CTAT}$ 164 and the mirror $I_{PTAT}$ 170 may be summed to generate the reference current $I_{reference}$ 172. FIG. 5 illustrate how the $I_{CTAT}$ 164 and the $I_{PTAT}$ 170 may be summed together to generate a reference current $I_{reference}$ 172 that is independent of PVT variations. The graph 200 depicts current behavior in circuit elements whose operational behavior depends on temperature variations. A line 202 may correspond to a magnitude of the mirror $I_{PTAT}$ 170. As shown, the magnitude of the mirror $I_{PTAT}$ 170 may increase as the temperature increases. Such current behavior may be seen across diodes and/or other elements composed of active material. Further, a line 204 may correspond to a magnitude of the mirror $I_{CTAT}$ 164, which may decrease as the temperature increases. Such current behavior may be seen across resistors with resistances that increase as temperature increase. Regardless of the temperature value, when the mirror $I_{PTAT}$ 202 current and the mirror $I_{CTAT}$ current 204 are added together, the resulting sum is the $I_{reference}$ 206 current. As shown, the $I_{reference}$'s 172 value does not fluctuate as the temperature varies. The stable behavior is a result of the complimentary nature of the mirror $I_{PTAT}$ 202 and mirror $I_{CTAT}$ 204 currents. Returning to FIG. 4, $I_{reference}$ 172 may be provided to circuit components 174 of the semiconductor device 10, such as an oscillator of the low power double data rate type 5 (LPDDR5) memory device. Additionally or alternatively, the $I_{reference}$ 172 may be provided to a comparator near an oscillator.

Embodiments of the present disclosure relate to generating a PVT-independent reference current in a resource-efficient manner by using outputs of a bandgap circuit. By implementing the mirror PTAT branch 168 in a current mirror configuration with the bandgap circuit 40, the $I_{PTAT}$ current may be emulated (e.g., mirrored) from the bandgap circuit using circuit elements that are relatively smaller than a resistor and consume less power than the resistor. As such, a stable current, independent of PVT variations, may be generated in a resource-efficient manner for mobile electronic devices.

While the present disclosure may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is intended to cover all modifications, equivalents, and alternatives falling within the spirit and scope of the present disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An apparatus, comprising:

a bandgap circuit configured to output a reference voltage and a gate signal;

a reference current circuit comprising:

a complementary-to-absolute-temperature (CTAT) current generation portion configured to generate a CTAT current and an additional gate signal; and a variation-independent reference current generation portion configured to:

receive the gate signal from the bandgap circuit;

apply the gate signal to a proportion-to-absolute temperature (PTAT) branch of the variation-independent reference current generation portion to couple the variation-independent reference current generation portion and the bandgap circuit in a current mirror configuration;

generate a mirror PTAT current upon applying the gate signal to the PTAT branch; and generate a mirror CTAT current in a CTAT branch of the variation-independent reference current generation portion based at least in part on the additional gate signal; and a reference node configured to generate a reference current supply based at least in part on the mirror CTAT current and the mirror PTAT current.

2. The apparatus of claim 1, wherein the bandgap circuit is configured to generate a bandgap PTAT current.

3. The apparatus of claim 2, wherein generating the mirror PTAT current comprises mirroring the bandgap PTAT current in the PTAT branch upon applying the gate signal.

4. The apparatus of claim 1, wherein the reference current supply comprises a sum of the mirror CTAT current and the mirror PTAT current to reduce effects of PVT variations on a reference current output from the reference current supply.

5. The apparatus of claim 1, wherein the CTAT current generation portion is configured to generate the CTAT current based at least in part on the reference voltage from the bandgap circuit.

6. The apparatus of claim 1, wherein the mirror CTAT current used to generate the reference current supply is a mirrored current of the CTAT current generated by the CTAT current generation portion.

7. The apparatus of claim 1, wherein the mirror CTAT current is generated by coupling the CTAT branch of the variation-independent reference current generation portion to the CTAT current generation portion using the additional gate signal.

8. Circuitry for generating a reference current, comprising:

a complementary-to-absolute-temperature (CTAT) current generation portion comprising a CTAT branch configured to generate a first CTAT current; and a variation-independent reference current generation portion comprising:

a mirror CTAT branch configured to generate a second CTAT current that mirrors the first CTAT current;

a mirror PTAT branch configured to generate a PTAT current that mirrors a bandgap PTAT current generated in a bandgap circuit configured to perform bandgap filtration; and a reference node coupling the mirror CTAT branch and the mirror PTAT branch, wherein the reference node is configured to generate the reference current based at least in part on the second CTAT current and the PTAT current.

9. The circuitry of claim 8, wherein the CTAT current generation portion generates the first CTAT current based at least in part on a reference voltage received at an operational amplifier coupled to the CTAT branch, wherein the bandgap circuit generates the reference voltage.

10. The circuitry of claim 8, wherein the mirror CTAT branch and the CTAT current generation portion are coupled in a current mirror configuration.

11. The circuitry of claim 8, wherein the mirror PTAT branch and the bandgap circuit are coupled in a current mirror configuration.

12. The circuitry of claim 8, wherein the mirror PTAT branch generates the PTAT current based on a gate signal generated by the bandgap circuit.

13. The circuitry of claim 8, wherein the reference current comprises a sum of the mirror CTAT current and the PTAT current to reduce effects of PVT variations on the reference current output from the reference node.

14. A variation-independent reference current generation circuitry, comprising:

a complementary-to-absolute-temperature (CTAT) branch configured to generate a mirrored CTAT current, wherein the CTAT branch comprises:

a first transistor comprising:

a gate terminal configured to receive a first gate signal from CTAT current generation circuitry;

a source terminal coupled to a supply voltage; and a drain terminal coupled to an operational transconductance amplifier (OTA); and a second transistor comprising:

a gate terminal coupled to the OTA;

a source terminal coupled to the OTA and to the drain terminal of the first transistor; and a drain terminal;

a proportional-to-absolute-temperature (PTAT) branch configured to generate a mirrored PTAT current, wherein the PTAT branch comprises:

a third transistor comprising:

a gate terminal configured to receive a second gate signal from a bandgap circuit; and a source terminal coupled to the supply voltage; and a drain terminal; and a fourth transistor coupled to the drain terminal of the third transistor and a drain terminal of the second transistor, wherein the CTAT branch and the PTAT branch together are configured to output a reference current.

15. The variation-independent reference current generation circuitry of claim 14, wherein the fourth transistor is coupled to the drain terminal of the second transistor at a reference node configured to output the reference current.

16. The variation-independent reference current generation circuitry of claim 15, wherein the reference node sums the mirrored CTAT current and the mirrored PTAT current to generate the reference current.

17. The variation-independent reference current generation circuitry of claim 14, comprising the OTA coupled to the drain terminal of the first transistor and to the source and gate terminals of the second transistor, wherein the OTA is configured to:

receive a reference voltage from the bandgap circuit; and supply the reference voltage and an output voltage based on the reference voltage to the CTAT branch.

18. The variation-independent reference current generation circuitry of claim 14, wherein the PTAT branch is configured to generate a mirrored PTAT current that emulates a PTAT current generated in the bandgap circuit.

19. The variation-independent reference current generation circuitry of claim 14, wherein the PTAT branch and the bandgap circuit are coupled in a mirror.

20. The variation-independent reference current generation circuitry of claim 14, wherein the CTAT branch is coupled to a CTAT current generation circuitry configured to generate a CTAT current, wherein the mirrored CTAT current emulates the CTAT current.

* * * * *